United States Patent [19]

Bluhm et al.

[11] Patent Number: 4,572,458

[45] Date of Patent: Feb. 25, 1986

[54] COMPACT CREEL FOR LARGE DIAMETER YARN SUPPLY PACKAGES

[75] Inventors: Dieter H. Bluhm; Volker Drumm, both of Charlotte, N.C.

[73] Assignee: American Barmag Corporation, Charlotte, N.C.

[21] Appl. No.: 671,450

[22] Filed: Nov. 14, 1984

[51] Int. Cl.[4] ..... B65H 49/02; D02H 1/00; D03J 5/08

[52] U.S. Cl. ..... 242/131

[58] Field of Search ..... 242/131, 131.1, 128, 242/130; 66/125 R

[56] References Cited

U.S. PATENT DOCUMENTS

| | | | |
|---|---|---|---|
| 2,842,323 | 7/1958 | Rayburn | 242/128 |
| 3,693,904 | 9/1972 | Bucher | 242/131 |
| 3,930,623 | 1/1976 | Walden | 242/131 |

*Primary Examiner*—Leonard D. Christian

*Attorney, Agent, or Firm*—Bell, Seltzer, Park & Gibson

[57] ABSTRACT

This compact creel is adapted to continuously supply yarns from unusually large diameter yarn supply packages to a textile yarn processing machine having an elongate frame and a plurality of spaced-apart yarn processing stations therealong. The creel is formed with a row of closely spaced yarn support frames supported for limited rotary movement and in parallel spaced relationship from the machine frame to provide a passageway between the creel and the textile machine. Each of the support frames includes three vertically spaced decks with four pairs of yarn supply packages in spaced-apart positions on each deck. The yarn supply packages are supported with the yarn withdrawal ends of adjacent packages in substantially facing relationship to each other so that one of the large diameter yarn supply packages acts as a yarn feeding supply package while the other yarn supply package is tailed thereto and acts as a reserve yarn supply package. Yarn guide means is positioned between the facing yarn withdrawal ends of each of the paired yarn supply packages and functions as a yarn feeding position and for guiding the yarn as it is withdrawn from the paired yarn supply packages and directed to the textile yarn processing machine.

21 Claims, 6 Drawing Figures

COMPACT CREEL FOR LARGE DIAMETER YARN SUPPLY PACKAGES

FIELD OF THE INVENTION

This invention relates generally to a compact yarn supply creel adapted to support unusually large diameter yarn supply packages for continuous feeding of yarn to a textile yarn processing machine, and more particularly to such a creel in which the large diameter supply packages are supported in vertical rows on a rotary frame positioned adjacent the textile machine for easy donning of full supply packages and doffing of empty supply packages and without requiring a substantial increase in the overall dimensions of the creel.

BACKGROUND OF THE INVENTION

As the speed of operation of textile yarn processing machines, such as yarn texturing machines, has increased in recent years, it has become necessary to replenish yarn supply packages more often and this results in an increase in the cost of operating the machines and in the cost of producing textured yarn thereon. The faster withdrawal of yarn from the yarn supply packages has prompted manufacturers to recognize the advantage to be gained by using larger diameter yarn supply packages. In producing larger size yarn supply packages, the yarn producers have increased the diameter of the yarn supply package but have maintained the width or yarn traversing surface substantially the same. The width or yarn traversing surface of the yarn packages have not been increased because the tension and other yarn withdrawal characteristics may be undesirably changed.

In order to provide a continuous supply of feeder yarn, the supply packages have been paired with one package being an active yarn feeding package and the other adjacent package being tailed thereto and acting as a reserve supply of yarn. These adjacent pairs of yarn supply packages have normally been supported with the longitudinal axis of the yarn supply packages in acute angular relationship with each other so that the yarn withdrawal ends face in generally the same direction and toward a yarn guide positioned at the apex of the acute angle formed by the longitudinal axis of each of the yarn packages. With the paired supply packages being supported in this position, an increase in the diameter of the packages has resulted in the need for a greater distance to be provided between the longitudinal axis of each of the paired yarn supply packages, thereby requiring a greatly enlarged increase in the dimensions of the yarn creel.

In many instances, the textile yarn processing machines are positioned in a manufacturing plant with a certain spacing therebetween and it is not possible to increase the size of the adjacent yarn supply creels because of the limited floor space. In some instances, the creels have been increased in height in order to support the larger diameter supply packages. However, increasing the height of the creel also creates problems of positioning unusually heavy, full yarn packages on the creel, particularly at the higher elevations. Also, the vertical extension of the creel creates problems by forming objectionable tortuous yarn paths for movement of the feeder yarn from the yarn supply package to the yarn processing station of the textile machine.

As yarn supply packages of larger diameter have become more popular, such as 50 pound POY yarn packages having a diameter of approximately 14 inches and a yarn width of approximately 10 inches, the standard fixed type of creels have been replaced by rotary creels which conserve space and provide easier replacement of the exhausted yarn supply packages. One example of this type of rotary yarn supply creel is disclosed in German Offenlegungsschrift No. 34 08 808 published Sept. 20, 1984. The creel of this publication has the advantages of being able to rotate the creel to move the yarn package support spindles from their normal position to a convenient position for replacing exhausted yarn supply packages. However, both the paired feeding and reserve yarn supply packages of this publication are supported on the creel in generally the conventional acute angular position relative to each other, as has been used for years in the fixed type of creel. In this arrangement, the feeding yarn supply package and adjacent reserve yarn package are supported with their axes in an acute angular relationship to each other and with the yarn withdrawal ends of the yarn supply packages facing inwardly toward the center of the rotary creel.

When 50 pound yarn supply packages are supported on the creel of this publication, the large diameter of the feeding yarn supply package and adjacent reserve yarn supply package does not permit placing two full yarn supply packages on adjacent supporting spindles. Thus, a full reserve yarn supply package can be placed on its support spindle only after the diameter of the adjacent feeding yarn supply package has been considerably reduced. Also, the construction of the rotary creel of this publication does not lend itself to the automated donning and doffing the yarn supply packages. In order to adapt this type of creel to support even larger diameter yarn supply packages, such as 100 pound POY yarn packages having a diameter of approximately 21 inches and a yarn width of approximately 10 inches, the dimensions of the support creel would have to be greatly increased.

SUMMARY OF THE INVENTION

With the foregoing in mind, it is an object of the present invention to provide a compact creel for continuously feeding yarn to a textile yarn processing machine, such as a yarn texturing machine, from adjacent large diameter feed and reserve yarn supply packages which are supported on individual rotary frames with their yarn withdrawal ends in facing relationship with each other so that full diameter feed and reserve yarn supply packages can be provided in adjacent positions without requiring a substantial increase in the dimensional size of the individual rotary frames or the complete yarn creel.

The compact creel of the present invention is particularly adapted to feed yarn to a textile machine from yarn packages having unusually large diameters, such as 100 pound POY yarn supply packages, in which the diameter of the package is at least two times the width of the yarn wound thereon. The yarn supply packages are supported on the rotary frames of the creel in paired relationship with each pair of yarn supply packages including a feed package and a reserve package tailed together to provide continuous yarn supply to the textile machine. Preferably, the paired yarn supply packages are supported in four equally spaced locations, defining the four corners of a square, and the facing relationship of the withdrawal ends of the paired yarn supply packages permits the packages to be positioned closely enough together that the distance between opposite sides of the square, defined by the four support locations of the supply packages, is less than two times the diameter of the large diameter yarn supply packages carried on the creel.

The rotary frames of the creel each preferably includes three vertically spaced decks of yarn supply packages with each deck including four pairs of unusually large diameter yarn supply packages. The yarn packages are supported on pivoted spindles carried by four equally spaced pairs of vertical support posts. The pivoted spindles are supported on the four pairs of vertical support posts for movement to an inner position where adjacent yarn packages are supported with their corresponding yarn withdrawal ends in substantially facing relationship to each other. The yarn supply package support spindles are also movable outwardly to a loading position where they extend outwardly from the rotary frame to facilitate removing the empty yarn supply package support and replacing the same with a full yarn supply package. A yarn guide is supported between the facing yarn withdrawal ends of adjacent paired yarn supply packages for guiding the yarn as it is withdrawn from the yarn supply packages and directing the yarn to the textile machine. The yarn guide is positioned at the apex of the longitudinal axis of the paired yarn feeding and reserve supply packages with the longitudinal axis of each of the adjacent paired yarn supply packages being positioned at an obtuse angle relative to each other. As has been pointed out, this positioning of the paired yarn supply packages with the yarn withdrawal ends generally facing each other and the longitudinal axes defining an obtuse angle is in contrast to the usual manner in which such yarn supply packages are positioned, that is, with the yarn withdrawal ends generally facing in substantially the same direction and with the longitudinal axes of the yarn packages defining an acute angle.

When the compact yarn supply creel of the present invention is used in association with a textile yarn processing machine having an elongate frame with a plurality of yarn processing stations spaced therealong, such as a yarn texturing machine, the creel includes a row of closely spaced yarn support frames with each of the yarn support frames being supported for limited rotary movement about a vertical axis. The row of yarn support frames extends parallel to and in spaced relationship from the textile machine frame and provides a passageway between the creel and the textile machine. The supporting of the yarn support frames for limited rotary movement permits the yarn support frames to be rotated to a position where any exhausted yarn supply packages face an access aisle so that they may be easily doffed and full supply packages replaced thereon.

It is also preferred that the three decks of yarn supply packages at each of the corners of the yarn support frame each be removably supported thereon to facilitate automation of the donning and doffing of the yarn supply packages. In order to facilitate the replacement of exhausted yarn supply packages, the rotary yarn support frames are provided with drive means for rotating the support frames to a position where the exhausted yarn supply packages may be easily removed and replaced from the access aisle extending along one side of the row of yarn support frames.

BRIEF DESCRIPTION OF THE DRAWINGS

Other objects and advantages will appear as the description proceeds when taken in connection with the accompanying drawings in which.

DESCRIPTION OF THE ILLUSTRATED EMBODIMENT

Figure 1:
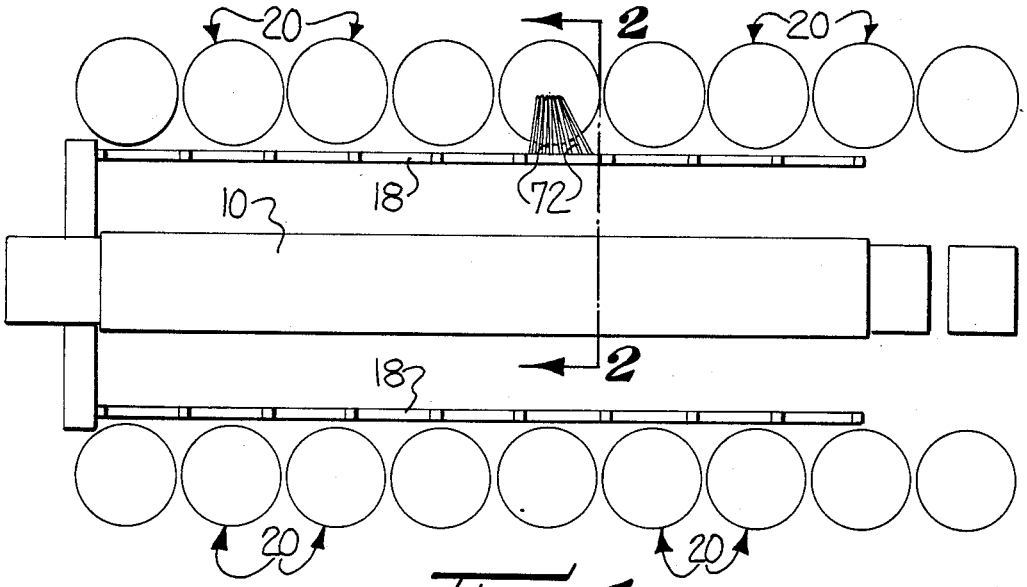
FIG. 1 is a somewhat schematic plan view illustrating the elongate frame of the textile machine with the rows of closely spaced yarn support frames extending along opposite sides and spaced from opposite sides of the textile machine.

The compact creel of the present invention is schematically illustrated in FIG. 1 extending along and in spaced relationship from opposite sides of the elongate frame of a textile yarn processing machine 10 and providing a passageway between the creel and opposite sides of the textile machine. The textile yarn processing machine 10 is preferably of the yarn texturing type and is provided with a plurality of closely spaced yarn processing stations, such as texturing stations, spaced along the elongate frame and with the usual control and drive devices positioned at opposite ends thereof. The particular machine illustrated is provided with nine sections along each side and with twelve yarn texturing stations in each section.

Figure 2:
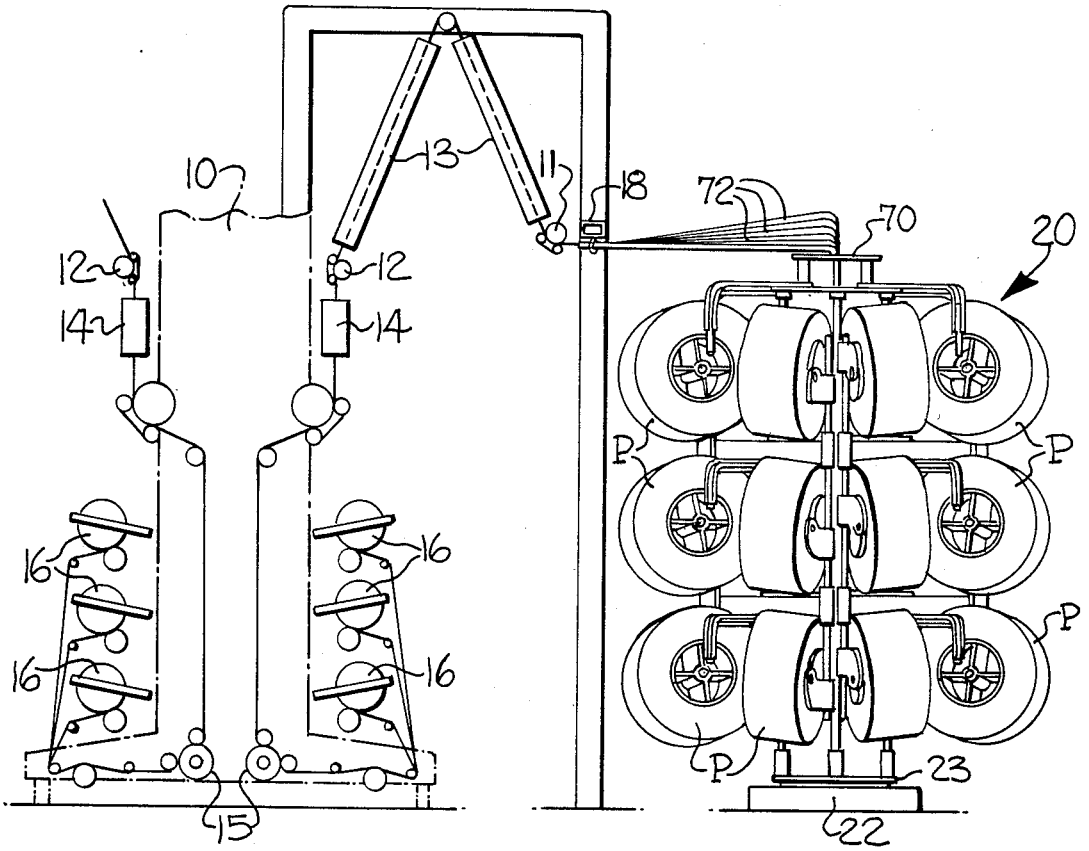
FIG. 2 is a vertical sectional view along the line 2—2 in FIG. 1 and schematically illustrating the yarn path through one yarn processing station on each side of the machine, and an elevational view of one yarn support frame of the creel.

As illustrated in FIG. 2 each yarn texturing station includes a positive input yarn feed device 11, guide means for directing the yarn across and above the passageway to a second positive yarn feed device 12. The yarn preferably passes through one or more yarn heating devices 13 and is drawn or orientated to the proper degree by the adjustment of the feeding speed of the yarn feed devices 11, 12. The yarn then passes through a yarn texturing device 14, such as false twist friction disks or an air jet. The yarn is then directed downwardly and through suitable heaters, not shown, and around another positive drive device 15, and then upwardly where it is taken up on one deck of take-up packages, indicated at 16. The take-up packages are arranged in vertical spaced relationship to take up the yarn from three adjacent yarn texturing stations.

Figure 3:
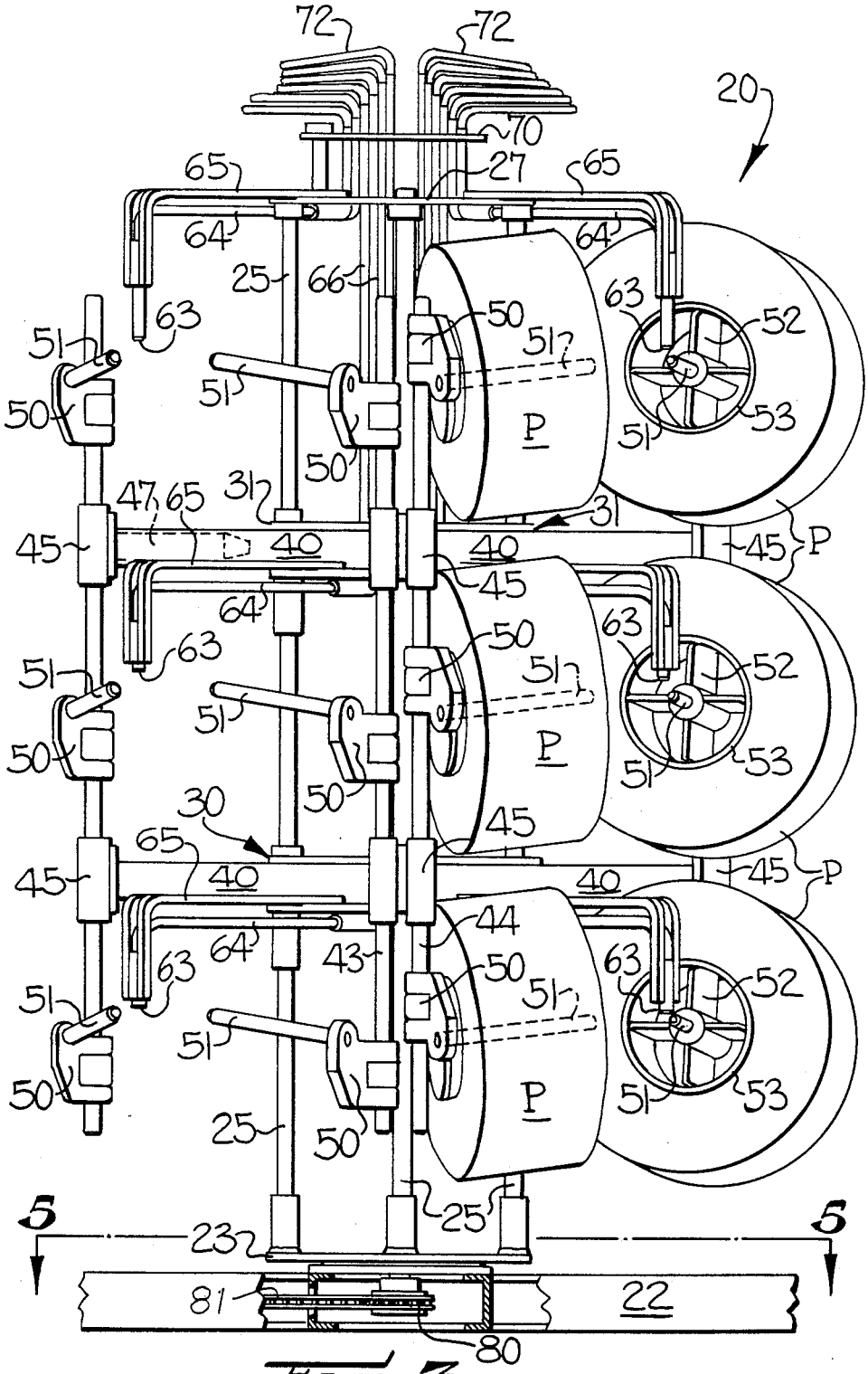
FIG. 3 is an enlarged elevational view of one yarn support frame, looking at the right-hand side of FIG. 2, and with certain of the yarn supply packages removed to more clearly illustrate the structure of the yarn support frame.
Figure 6:
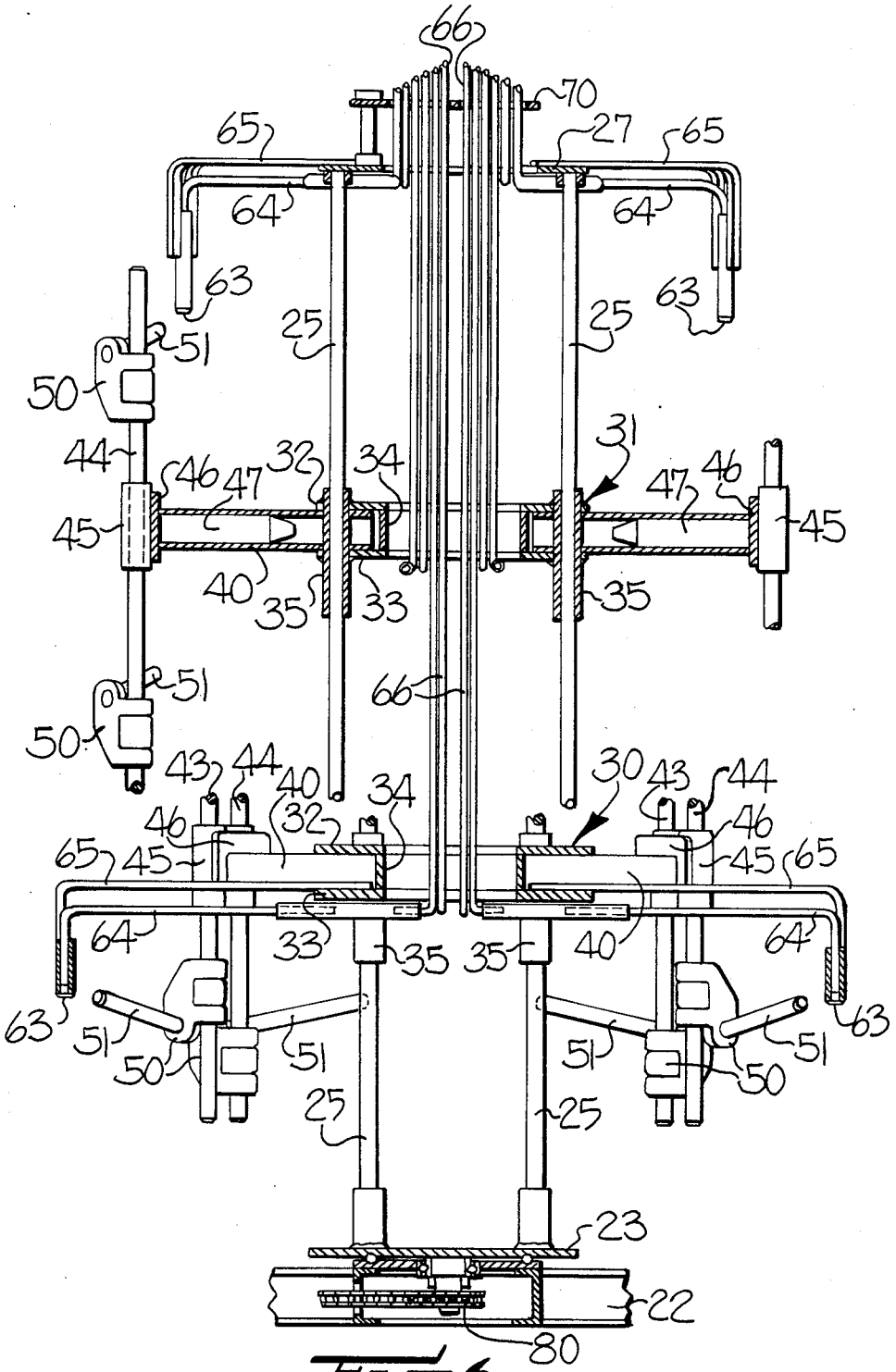
FIG. 6 is a vertical sectional view taken substantially along the line 6—6 in FIG. 4, with the lower portion being rotated 45 degrees from the position of the upper portion.

A frame 18 is spaced along opposite sides of the textile yarn processing machine 10 and, as schematically illustrated in FIG. 1, it is divided into nine separate sections corresponding to the nine sections of the yarn texturing machine 10, and with each of the nine sections including twelve yarn texturing stations. The yarn creel is provided with elongate rows of closely spaced individual yarn support frames, indicated broadly at 20. Each of the support frames 20 supports a sufficient number of large diameter yarn supply packages to continuously supply yarn to each of the nine sections of the textile machine 10. The rows of yarn support frames 20, schematically illustrated as circles in FIG. 1, are constructed in the same manner and only one of the yarn support frames will be described in detail. The yarn support frame 20 is supported for limited rotary movement about a vertical axis and on a base frame 22. A circular rotary plate 23 is supported for rotation on suitable bearing means, as illustrated in FIG. 6, on the base frame 22 and has the lower ends of four vertical support shafts 25 fixed to the upper surface thereof. As illustrated in FIG. 3, the four vertical support shafts 24 extend upwardly from the rotary plate 23 and to substantially the upper ends of the creel support frame 20 and their upper ends are fixed to the lower surface of an upper circular support plate 27.

A pair of intermediate support plate means, broadly illustrated at 30 and 31, is supported in spaced-apart respective lower and upper positions on the vertical support shafts 25. Each of the support plate means 30, 31 includes respective upper and lower circular support plates 32, 33 (FIG. 6) which are each provided with a central opening and are held in fixed relationship with each other by a circular tubular support member 34 suitably fixed to the plates 32, 33 as by welding. The vertical support shafts 25 extend through the plate members 32, 33 and suitable tubular guides 35 fixed to the plate members. The tubular guides 35 are adjustably supported on the vertical support shafts 25 so that vertical adjustment of the support plate means 30, 31 may be provided.

Figure 4:
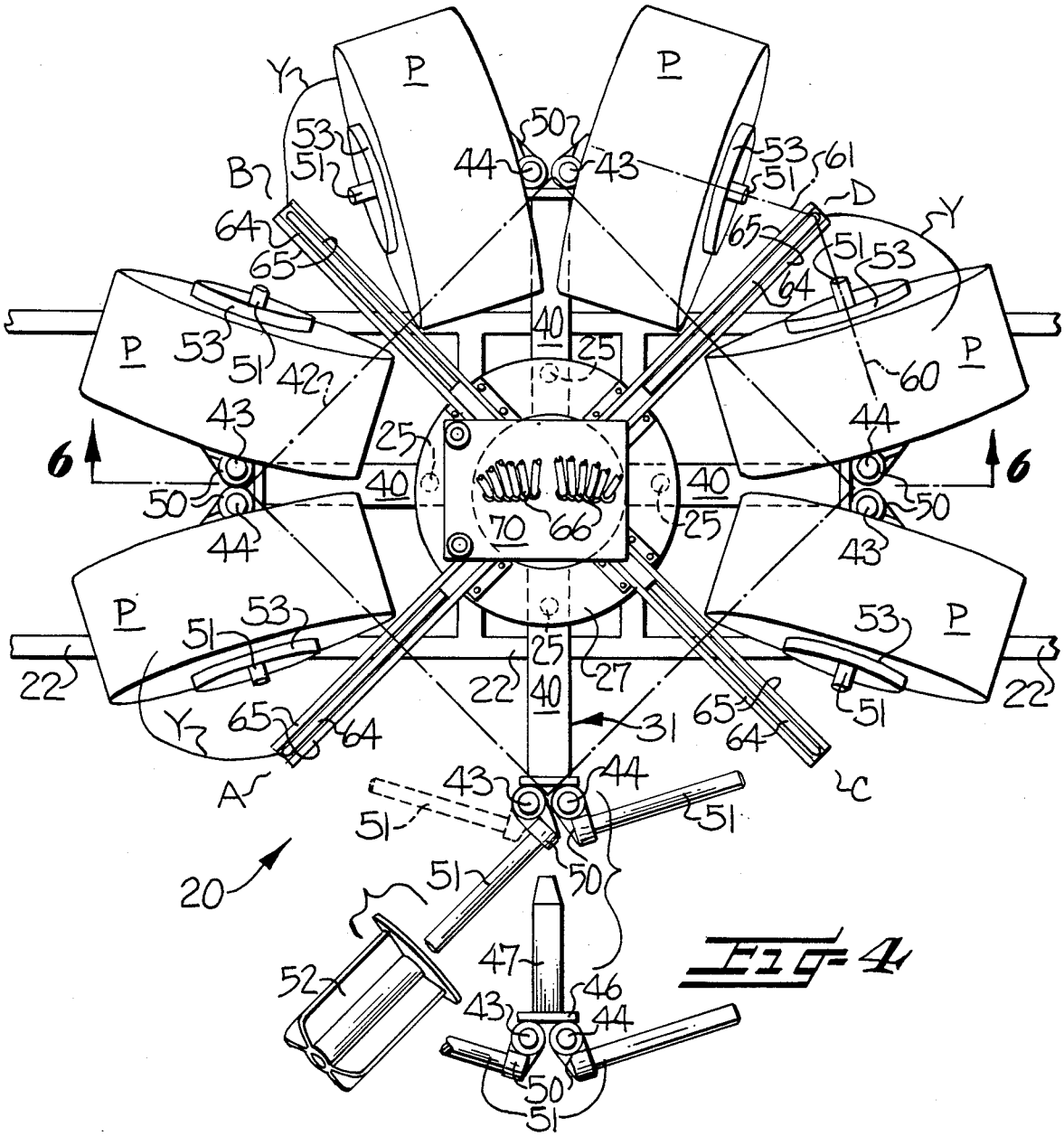
FIG. 4 is a plan view of the yarn support frame of FIG. 3 with certain of the parts in exploded condition.

Radially extending square tubular support arms 40 are fixed at their inner ends in position between the upper and lower plates 32, 33 and extend outwardly therefrom in a radial direction and in 90-degree relationship to each other, as illustrated in FIG. 4. As best illustrated in FIG. 4, the outer ends of the support arms 40 define the corners of a square 42, indicated by the dash-dot lines in FIG. 4.

Yarn package support means is removably supported on the outer ends of each of the support arms 40 and is illustrated in the form of adjacent pairs of vertical yarn support posts 43, 44 which are supported for vertical adjustment in support sleeves 45 (FIG. 6). Adjacent pairs of the support sleeves 45 are fixed to a support plate 46 which is in turn fixed to the outer end of a horizontally extending square support shaft 47, adapted to be slidably engaged in the inner portion of the square support arm 40. The horizontal support shafts 47 are normally maintained in fixed relationship inside of the square support arms 40 by any suitable means, such as set screws or the like, and may be moved outwardly in a radial direction and removed therefrom, in the manner illustrated in the lower portion of FIG. 4, to facilitate automation of the doffing operation. In this instance, the support for the group of six packages may be referred to as a cassette, which can be loaded and unloaded by automatic means, such as a robot or the like. This will permit the yarn supply packages to be replaced in a location remote from the creel.

The four pairs of vertical yarn support posts 43, 44 are supported along their medial portions by the lower and upper support plate means 30, 31 and extend downwardly below and upwardly above the respective support plate means 30, 31 and vertically spaced yarn package support means is carried thereby. The yarn package support means each includes a pivoted bracket 50 supported for pivotal movement on the corresponding vertical yarn support post 43, 44 and has the inner end of a yarn support spindle 51 fixed therein. As illustrated in FIG. 3, the yarn support spindle 51 is preferably inclined upwardly at an angle of approximately seven degrees and is adapted to slidably receive a yarn package support hub 52 over the outer end thereof (FIG. 4). The yarn package support hub 52 is preferably formed of molded plastic and is provided with four radially spaced outwardly extending support ribs thereon.

The outer diameter of the yarn support hub 52 is adapted to slidably receive the inner diameter of a yarn supply core or tube 53 on which the large diameter yarn supply package, indicated at P, is wound. As heretofore indicated, the creel of the present invention is particularly adapted to support unusually large diameter yarn supply packages containing approximately 100 pounds of yarn and known as 100 pound POY (partially orientated yarn) packages having a diameter of approximately 21 inches and a yarn width or yarn traversing surface of approximately 10 inches. The yarn is wound on the package in a suitable manner to facilitate the withdrawal of the yarn over one end of the yarn supply package P. As best shown in FIGS. 3 and 4, adjacent yarn supply packages P are supported on the adjacent vertical yarn support posts 43, 44 at the same horizontal level and face in substantially opposite directions therefrom. The withdrawal ends of the paired yarn supply packages P are in substantially facing relationship with each other so that one of the yarn supply packages P acts as a feeding yarn supply package while the other paired yarn supply package P is tailed thereto and acts as a reserve yarn supply package.

As illustrated in the upper right-hand portion of FIG. 4, the yarn, indicated at Y, is being withdrawn from one end of the right-hand yarn feeding supply package while the left-hand supply package is tailed thereto and acts as the reserve package so that the yarn will be withdrawn from the left-hand package after all of the yarn has been withdrawn from the right-hand package. The longitudinal axis of the yarn feeding supply package is indicated by the dash-dot line 60 while the longitudinal axis of the reserve yarn supply package is indicated by the dash-dot line 61. It will be noted in FIG. 4 that the yarn feeding and reserve yarn packages have their withdrawal ends in substantially facing relationship to each other and the longitudinal axes 60 and 61 form the apex of an obtuse angle, which in the present instance is illustrated as being approximate 130 degrees.

Yarn guide means is provided for directing the yarn from the yarn feeding package to the textile machine and includes including a yarn guide eye 63 (FIG. 3) positioned between the facing yarn withdrawal ends of the paired yarn supply packages P for guiding the yarn as it is withdrawn from the paired yarn supply packages. The yarn guide 63 is positioned at the apex of the longitudinal axes 60, 61 of the paired yarn supply packages P and defines four equally spaced yarn feed positions, broadly indicated at A through D in FIG. 4, and defining the corners of a square, which is offset 45 degrees from the square 42 defined by the dash-dot lines.

The yarn guide eye 63 at each of the yarn feed positions A–D is supported in the lower end of the vertical leg of a yarn feed tube 64 which extends upwardly and then horizontally beneath the corresponding support plates 27, 30 and 31. Yarn guide support rods 65 are fixed at their inner ends to the respective support plates 27, 30 and 31 and support the outer end portions of the yarn supply tubes 64 in the proper positions between the paired yarn supply packages at each of the yarn feed stations A–D. The inner portions of the horizontal portions of the yarn feed tubes 64 are telescopically connected to the lower ends of vertical yarn feed tubes 66 which extend upwardly through the respective support plate means 30, 31 and the upper support plate 27 where their upper ends are fixed in a support plate 70 (FIGS. 4 and 6) maintained in spaced relationship above the upper support plate 27.

The upper ends of the vertical yarn feed tubes 66 are suitably connected to horizontal yarn feed tubes 72 with their ends being horizontally staggered, for purposes to be presently described. The opposite ends of the yarn feed tubes 72 are suitably supported on the creel frame 18 (FIG. 2) and in spaced-apart relationship to feed the respective twelve yarns from each of the yarn support frames 20 and to each of the twelve yarn processing stations in each section of the textile machine 10, as schematically illustrated in FIG. 1. It is preferred that the horizontal portions of the guide tubes 72 be provided with suitable telescopic portions to permit limited rotation of the individual yarn support frames 20, in a manner to be presently described.

Thus, each yarn support frame 20 of the creel of the present invention is adapted to support a paired feeding and reserve yarn package at each of four yarn feeding positions at each of three vertically spaced yarn feeding decks so that twelve yarns are continuously fed from each of the yarn support frames 20. The positioning of the yarn supply packages P with their withdrawal ends in substantially facing relationship permits a total of 24 full yarn supply packages to be positioned on the yarn support frame 20 at one time and still permits the yarn packages to be moved between the feeding position, facing each other, and a reloading position, facing outwardly, by simply moving the pivoted yarn support spindle 51 between the dotted and solid line positions shown in the lower portion of FIG. 4.

The doffing of the empty supply packages and the donning of full supply packages usually takes place along an access aisle adjacent the outside of the rows of yarn support frames 20. To facilitate this operation, the frame 20 is supported for a limited rotary movement, as heretofore described, and is preferably provided with some type of drive mechanism for imparting limited rotary or indexing movement to each of the yarn support frames 20 so that the position to be replenished is rotated to a position where the corresponding yarn feeding position A–D is facing the access aisle.

Figure 5:
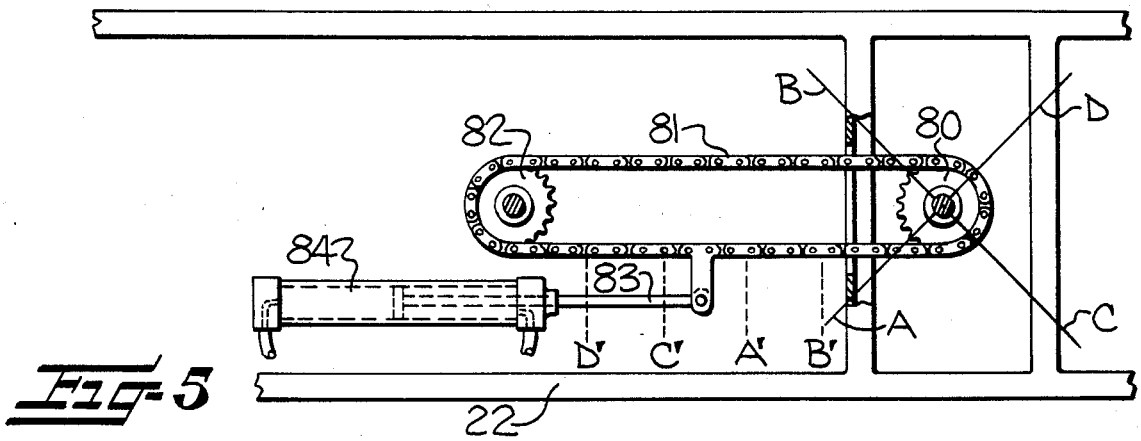
FIG. 5 is a sectional plan view taken substantially along the line 5—5 in FIG. 3 and illustrating one form of drive means for imparting limited rotation or indexing movement to the yarn support frame.

Limited rotary movement of the yarn support frame 20 in both directions is provided in the present instance by a drive sprocket 80 fixed on the lower hub portion of the rotary plate 23 (FIGS. 3, 5 and 6). A sprocket chain 81 extends around the drive sprocket 80 and around a second sprocket 82 which may be supported on the base frame 22 and act as an idler. Also, this sprocket 82 could be fixed on the lower hub of an adjacent rotary plate 23 of an adjacent yarn support frame 20, if desired. One run of the chain 81 is fixed to the outer end of a suitable drive mechanism, which may be of the type illustrated in FIG. 5 as a piston rod 83 of an operating cylinder 84 which is operable to maintain the drive mechanism in the yarn feeding position shown in FIG. 5. The cylinder 84 is also operable to move the drive chain 81 between the dotted line positions A′–D′ and thereby rotate the yarn support frame 20 throughout the desired degrees of rotation in either direction to present exhausted yarn supply packages in the lower portion of FIG. 4 for ease of donning and doffing.

With the drive mechanism in the position shown in FIG. 5, the yarn support frame 20 is in the yarn feeding position shown in FIG. 4 with the yarn feed positions A–D located in the positions shown. Movement of the piston rod 83 and chain 81 to the position indicated by the dotted line A′ will move the yarn support frame 45 degrees in a counterclockwise direction so that the yarn feed position A faces the reloading aisle on the outside of the creel. In this position, either of the paired yarn feed or reserve yarn supply packages P may be replenished by simply pivoting the corresponding spindle 51 outwardly so that the yarn support spindle is in a convenient position facing the access aisle to remove the empty yarn supply package and replace the same with a full yarn supply package P. After the yarn supply package has been replaced, the yarn support frame 20 may be rotated back to the neutral or feeding position shown in FIG. 4 by simply returning the piston rod 83 and the chain 81 to the position shown in FIG. 5. The rotary movement of the yarn support frame 20 takes place without interrupting the continuous feeding of the yarn to the textile yarn processing machine.

When it is desired to replace a yarn supply package P at the yarn feeding position B, the piston rod 83 and the chain 81 are moved to the dotted line position B′ in FIG. 5 so that the yarn support frame 20 is rotated 135 degrees in a counterclockwise direction from the position shown in FIG. 4 so that adjacent paired yarn supply packages P at the yarn feeding position B are readily available for replacement of exhausted yarn supply packages. The yarn support frame 20 may then be rotated back to the neutral or yarn feeding position by moving the piston rod 83 and the chain 81 back to the solid line position shown in FIG. 5. The yarn support frame 20 may be rotated in the opposite direction to alternately position either the yarn feed positions C or D in the position adjacent the aisle for replenishing exhausted supply packages. To rotate the yarn support frame 20 in a clockwise direction, the piston rod 83 and chain 81 are moved to the dotted line position C′ or to the dotted line position D′ to position the corresponding yarn feed position C and D in the proper position for replacement of the yarn supply packages at the respective yarn feed positions.

As will be noted in FIG. 4, adjacent yarn supply packages are supported in what may be referred to as a back-to-back relationship on the vertical support posts 43, 44 while their yarn withdrawal ends generally face a neighboring vertical support post and adjacent pairs of yarn supply packages are supported with their withdrawal ends generally facing each other. This positioning of the yarn supply packages enables the size of the yarn creel to be maintained substantially the same as the dimensions heretofore used for creels constructed to support smaller yarn supply packages. As noted in FIG. 4, the distance between opposite sides of the square 42 defined by the four pairs of support posts 43, 44 is less than two times the diameter of the large diameter yarn supply packages P. If the 21-inch diameter yarn supply packages were positioned in the normal manner, with the apex of the longitudinal axis of the yarn supply packages extending inwardly and defining an acute angle, the distance between the corner support posts 42, 43 would be greatly enlarged and also greatly increase the diameter of the circle defining the outer portions of the yarn supply packages P. Such an increase in size would either reduce the width of the access aisle between adjacent creels of adjacent textile machines, or there would not be sufficient space for the creel between adjacent textile machines. Such an increase in the diameter of the circular space required for each yarn support frame 20 would also require an increase in the overall length of the creel extending along both sides of the textile yarn processing machine.

While the yarn support frames 20 are illustrated in the present application as being particularly adapted for supporting four pairs of yarn supply packages on each of three vertically spaced decks, it is to be understood that other package support arrangements could be employed. For example, the yarn support frame 20 could be provided with four decks, each of which supports three pairs of yarn supply packages. Also, the yarn support frame 20 could be provided with four decks of four pairs of yarn supply packages In the drawings and specification there has been set forth the best mode presently contemplated for the practice of the present invention, and although specific terms are employed, they are used in a generic and descriptive sense only and not for purposes of limitation, the scope of the invention being defined in the claims.

We claim:

1. A compact creel for providing a continuous supply of feeder yarns to a textile yarn processing machine from unusually large diameter feeder yarn supply packages from which the yarn is adapted to be withdrawn over one end thereof, said creel comprising a frame, a plurality of yarn package support means carried by said frame in spaced-apart positions for supporting paired large diameter feeder yarn supply packages in spaced-apart positions with their corresponding yarn withdrawal ends in substantially facing relationship to each other with the angle between the longitudinal axes thereof being greater than 90 degrees, one of each of said pairs of large diameter feeder yarn supply packages being adapted to act as a yarn feeding supply package while the other paired yarn supply package acts as a reserve yarn supply package, and yarn guide means positioned at the apex of the angle formed by the longitudinal axes of the paired yarn supply packages for guiding the yarn as it is withdrawn from the paired yarn supply packages and for directing the yarn to the textile yarn processing machine.

2. A compact creel according to claim 1 wherein said angle between the longitudinal axes of the paired yarn supply packages comprises an obtuse angle greater than 90 degrees and less than 180 degrees.

3. A compact creel according to claim 2 wherein said obtuse angle is approximately 130 degrees.

4. A compact creel for providing a continuous supply of feeder yarns to a textile yarn processing machine from unusually large diameter feeder yarn supply packages in which the yarn is adapted to be withdrawn over one end thereof, said creel comprising a frame, a plurality of yarn package support means carried by said frame in spaced-apart positions for supporting paired large diameter feeder yarn supply packages in spaced-apart positions with their corresponding yarn withdrawal ends in substantially facing relationship to each other with an obtuse angle between the longitudinal axes thereof, one of each of said pairs of large diameter feeder yarn supply packages being adapted to act as a yarn feeding supply package whie the other paired yarn supply package acts as a reserve yarn supply package, and yarn guide means positioned between the facing yarn withdrawl ends of the paired yarn supply packages and at the intersection of the axes forming said obtuse angle, said yarn guide means being operable for guiding the yarn as it is withdrawn from the paired yarn supply packages and for directing the yarn to the textile yarn processing machine.

5. A compact creel according to claim 4 wherein said yarn package support means comprises a spindle for supporting each of the yarn supply packages, and including pivot means supporting one end of each of said spindles for pivotal movement on said frame so that said spindle may be pivoted to move the yarn supply package supported thereon between the facing position and a reloading position extending outwardly of said frame.

6. A compact creel according to claim 4 wherein the large diameter yarn packages each includes a diameter of at least two times the width of the yarn wound thereon.

7. A compact creel according to claim 4 including at least one deck of yarn supply packages comprising four pairs of large diameter yarn supply packages.

8. A compact creel according to claim 7 including three vertically spaced decks of yarn supply packages.

9. A compact creel according to claim 7 wherein said frame includes four equally spaced vertical support post means, and wherein each of said vertical support post means defines the four corners of a square.

10. A compact creel according to claim 9 wherein the distance between opposite sides of the square defined by said support post means is less than two times the diameter of the large diameter yarn supply packages.

11. A compact creel according to claim 10 including support plate means immediately above and below the medial deck of yarn supply packages, wherein said four vertical support post means includes medial portions and upper and lower end portions, and including means supporting the medial portions of each of said four vertical support post means on said support plate means with said upper and lower end portions of said vertical support post means extending above and below aid support plate means and supporting the corresponding upper and lower decks of yarn supply packages thereon.

12. A compact creel according to claim 11 wherein each of said four vertical support post means comprises a pair of adjacent vertical posts, wherein said pivot means comprises pivot brackets fixed on said vertical posts and in spaced vertical positions, and wherein said pivot brackets each support one end of each of said spindles thereon.

13. A compact creel according to claim 11 wherein said means supporting the medial portions of said pairs of adjacent vertical support posts on said support plate means includes mounting means permitting ready removal and replacement of said vertical support posts and the yarn supply packages carried thereby.

14. A compact creel according to claim 4 including means supporting said frame for limited rotary movement about a vertical axis and adjacent the textile yarn processing machine.

15. A compact creel according to claim 14 wherein said rotary support means includes drive means operable to impart rotary movement to said frame in selected opposite directions.

16. A compact creel for providing a continuous supply of feeder yarns to a textile yarn processing machine including an elongate frame with a plurality of yarn processing stations spaced therealong, said creel comprising a row of closely spaced yarn support frames, means supporting each of said yarn support frames for limited rotary movement about a vertical axis, said row of yarn support frames extending parallel to and in spaced relationship from said textile machine frame and providing a passageway between said creel and said textile machine, and a doffing aisle on the opposite side of said row of yarn support frames, each of said yarn support frames including yarn package support means supported on said frame and in spaced-apart positions and being adapted to support a plurality of paired large diameter yarn supply packages in spaced-apart positions with their corresponding yarn withdrawing ends in substantially facing relationship to each other, one of each of said pairs of large diameter yarn supply packages being adapted to act as a yarn feeding supply package while the other paired yarn supply package acts as a reserve yarn supply package, and yarn guide means positioned between the facing yarn withdrawal ends of the paired yarn supply packages for guiding the yarn as it is withdrawn from the paired yarn supply packages and for directing the yarn to the textile yarn processing machine.

17. A compact creel according to claim 16 including drive means associated with said supporting means of each of said yarn support frames for imparting selected amounts of rotary movement to said frame means in selected opposite directions to thereby position the yarn supply packages adjacent the doffing aisle.

18. A compact creel according to claim 16 wherein the unusually large diameter yarn packages each includes a diameter of at least two times the width of the yarn wound thereon.

19. A compact creel according to claim 18 wherein each of said yarn support frames includes three vertically spaced decks of yarn supply packages, and wherein each deck comprises four pairs of large diameter yarn supply packages.

20. A compact creel according to claim 19 wherein each of said yarn support frames includes four equally spaced vertical yarn package support means extending throughout the height of each of said three decks, and wherein each of said vertical yarn package support means defines the four corners of a square.

21. A compact creel according to claim 20 wherein the distance between opposite sides of the square defined by said vertical yarn package support means is less than two times the diameter of the large diameter yarn supply packages.

* * * * *